United States Patent [19]

Chen

[11] 4,165,718

[45] Aug. 28, 1979

[54] METHOD AND APPARATUS FOR FEEDING CONDENSATE TO A HIGH PRESSURE VAPOR GENERATOR

[76] Inventor: Thomas Y. C. Chen, 4142 Maqoun Ave., East Chicago, Ind. 46312

[21] Appl. No.: 841,490

[22] Filed: Oct. 12, 1977

[51] Int. Cl.[2] ..... F22D 5/28; F22D 5/30

[52] U.S. Cl. ..... 122/451 R; 122/456; 122/458

[58] Field of Search ..... 122/451 R, 452, 456, 122/457, 458

[56] References Cited

U.S. PATENT DOCUMENTS

| | | | |
|---|---|---|---|
| 759,660 | 5/1904 | Brazda | 122/457 |
| 977,841 | 12/1910 | Rollins | 122/456 |
| 2,011,626 | 8/1935 | Goff | 122/456 |
| 2,052,855 | 9/1936 | Twomey | 122/458 |
| 2,325,241 | 7/1943 | Gilmore | 122/456 |
| 2,870,751 | 1/1959 | Kuljian et al. | 122/451 |
| 3,116,876 | 1/1964 | Palm | 122/456 |

*Primary Examiner*—Kenneth W. Sprague
*Attorney, Agent, or Firm*—Hill, Van Santen, Steadman, Chiara & Simpson

[57] ABSTRACT

A mechanical arrangement to reduce drastically the energy consumption for pumping condensate to feed high pressure vapor generators for power generation, industrial processing, and heating systems. Involved is a method to pump the condensate into one condensate receiver located at the sucton side of the condensate feed pump, and to bleed high pressure vapor from the vapor generator into the condensate receiver for imposing a pressure head upon the condensate therein to be approximately the same as that in the generator, and thus the pressure difference between the suction side and the discharge side of the pump is also drastically reduced while pumping the condensate into the generator, with the result that the energy consumption of the pump is also drastically reduced. The receiver is full of high pressure vapor while the condensate therein is drained by the pump, and the high pressure vapor means energy. Further new methods are involved to reduce the vapor pressure in the receiver by returning the vapor to the system or to utilize it for other purposes, as disclosed in the application. Generally speaking, at least two closed receivers operated in series are required for the method of restoring the vapor in the receivers to the generator after the condensate is pumped into the generator. The invented disclosed receivers are also designed for condensate heating with almost no energy consumption.

31 Claims, 9 Drawing Figures

METHOD AND APPARATUS FOR FEEDING CONDENSATE TO A HIGH PRESSURE VAPOR GENERATOR

This invention relates to methods and apparatus for feeding condensate to a high pressure apparatus such as a vapor generator, and more specifically, the invention relates to methods and apparatus for feeding condensate to boilers, nuclear reactors, and heat exchangers.

There are basically only two ways to solve the current energy crisis. The first is to increase energy sources, and the second is to reduce energy consumption. This invention is concerned with practical applications of the latter.

The traditional method of returning condensate to a high pressure vapor generator is by pumping against the pressure head in the generator with a higher pressure head of the feeding pump. This consumes much energy, as for example, a steam turbine power plant with a steam boiler of 2,400 psig. pressure usually uses two pumps in series to feed the condensate into the boiler. The first pump pumps the condensate through a series of heaters into a deaerating tank, and the second pump pumps the condensate into the boiler. Usually the end of the suction pipe of the second pump is in the deaerating tank, and usually two additional heaters are employed between the second pump and the boiler. The second pump requires more than 2,700 psig. pressure head to overcome the pressure head in the boiler. the friction loss in the heaters and piping, and the water head due to the difference in level between the water level in the boiler and the water level in the suction side of the second pump.

An object of this invention is to reduce greatly the power used to pump the condensate to the high pressure vapor generator by utilizing the techniques herein disclosed.

Other objects, uses, and advantages will be obvious or apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of modifications that will be obvious to those skilled in the art, and that are intended to be covered by the appended claims.

DETAILED DESCRIPTION

Figure 1:
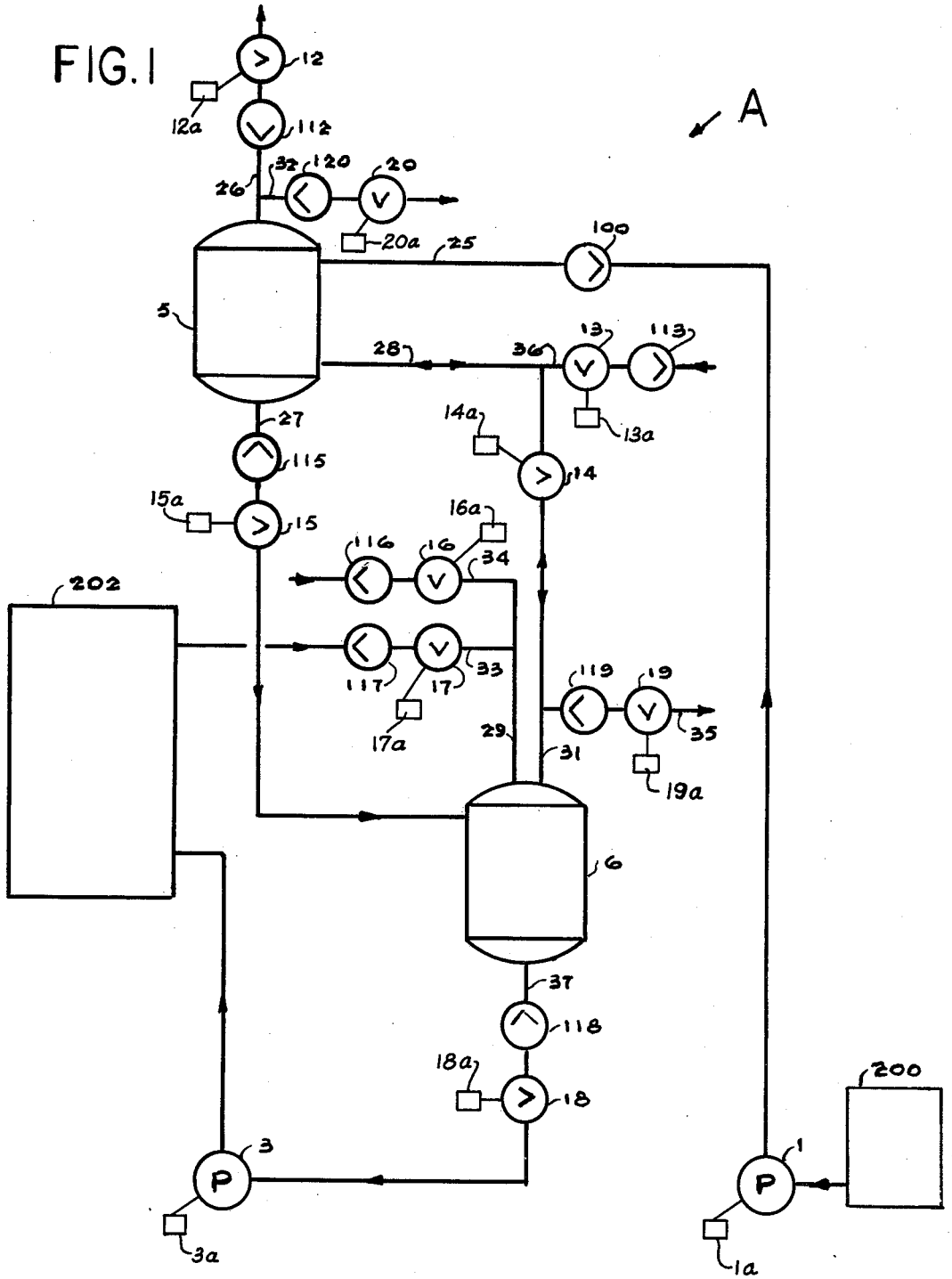
FIG. 1 is a diagrammatic representation of an energy saving condensate feeding system in accordance with the invention.

Referring to FIG. 1, the condensate feeding system A of this embodiment comprises condensate receivers 5 and 6 that are constructed in pressure vessel form from suitable material, such as steel, that will withstand internal pressures of up to 8,000 psig., depending upon the operating pressure. In situations where the quantity of oxygen in the processed fluid is enough to cause rust, stainless steel having a thickness in the range of from approximately ⅛th inch to approximately ½ inch can be used at all wetted parts of the receivers or vessels, as well as the inner surfaces of the piping employed in connection with same. Stainless steel piping and fittings can be used wherever it is financially feasible. All valves, except check valves, shown in FIG. 1, 5, 6 and 7 are of the generally opened automatic type, other automatic or manual valves can be employed in parallel with any such automatic valve as a standby valve in case of emergency. One shut off valve shall be installed at each side of an automatic valve.

A condensate feed line 25 connects to the receiver 5 near its top and contains a check valve 100. A pump 1 in the feed line 25 is operative to pump condensate to the receiver 5 from a suitable source, such as vessel 200 (the condensate in vessel 200 being supplied, for instance, from steam operated turbines utilizing system A).

A vent line 26 extends upwardly from the top of the receiver 5 and contains a check valve 112 and a shut off valve 12. A branch line 32 extends from the line 26 to make available processing vapor for external work. The line 32 contains a shut off valve 20 and a check valve 120. The check valves 112 and 120 prevent fluid flow back into the vessel 5. A condensate discharge line 27 leads from the bottom of the receiver 5 (at fitting 27A, see FIG. 2) to the receiver 6 near the top thereof for feeding condensate into receiver 6. The line 27 contains a shut off valve 15 and a check valve 115. Fluid (vapor, condensate, or both), inlet line 29 connects to the top of the receiver 6 and discharges into a distributor means which will be described hereinafter. The line 29 is supplied with fluid either from vapor generator 202 (represented by square) through the line 33 or with heating fluid through the line 34. These lines contain the respective shut off valves 16, 17, and check valves 116, 117, respectively.

A vapor discharge line 31 extends upwardly from the top of the receiver 6 for carrying vapor to the line 28. The line 31 contains shut off valve 14. The line 28 connects to receiver 5 near the bottom of same and serves to provide a way to equalize the pressures between receivers 5 and 6.

A branch line 35 extending from the line 31 serves as a source of supply vapor from receiver 6 to other processing equipment. Line 35 contains shut off valve 19 and check valve 119. Line 28 extends outwardly, as at 36, from the point where it connects line 31; line 36 connects to a source of heating fluid which may be vapor, condensate or a mixture of both (such source can be a turbine discharge in some cases). Line 36 extends from line 28 and contains shut off valve 13 and check valve 113 which permits flow only in the direction toward the receiver 5 from the indicated source of heating fluid.

Each of the lines 34, 35 and 36 for purposes of disclosure is intended to represent one fluid pipe or multiple fluid pipes in parallel, and each of the said multiple pipes are to contain a shut off valve and a check valve identical to those shown for the respective lines 34, 35 and 36.

Line 37 extends from the bottom of the receiver 6 (as from fitting 37A FIG. 2) to pump 3 which pumps condensate from the receiver 6 to the vapor generator 202. Line 37 contains shut off valve 18 and check valve 118, the latter permitting flow only in the direction from the receiver 6 to pump 3.

Figure 2:
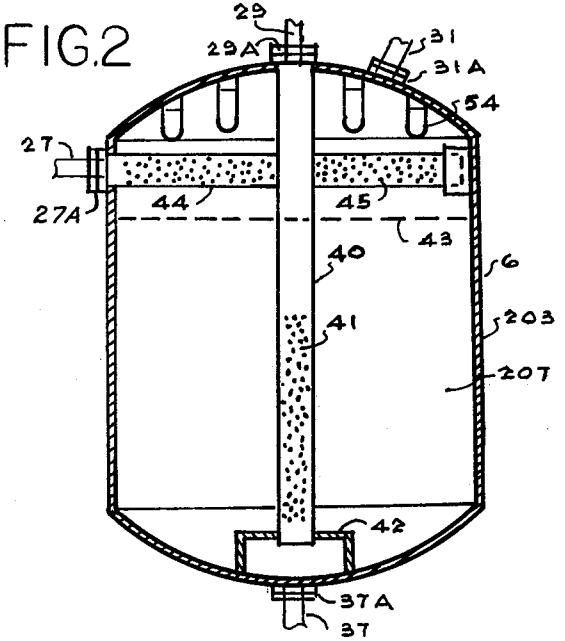
FIG. 2 is a diagrammatic elevational and sectional view, of one of the basic energy saving condensate receivers which is usually connected to the last feeding pump, in accordance with the invention.

Referring now to FIG. 2, which shows a detailed section through the receiver 6, it will be noted that the line 29 connects at fitting 29A to a vertically disposed distributor tube 40 having multiple openings 41 in the lower part of same. The lower end of the tube 40 is sealed and secured to the bottom of the vessel forming receiver 6 by means of suitable supports 42. The primary liquid level, indicated at 43, represents the lowest level to which the vessel or receiver 6 is to be filled with condensate. The line 31 (FIG. 1) connects with fitting 31A of the receiver 6, and the fitting 37A at the bottom of receiver 6 connects with line 37 (FIG. 1). A distributor 44 extends horizontally across the receiver 6 at the upper part of same and connects to the line 27 through the fitting 27A. Each of all said fittings is a fitting of an opening of the shell 203. The distributor 44 is in the form of tube 44A having a multiplicity of holes 45 formed in same about its circumference, within receiver 6.

Figure 4A:
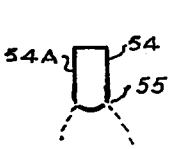
FIG. 4A is a diagrammatic sectional view taken substantially along line 4A—4A of FIG. 4.

The receiver 6 also has affixed to its upper end one or more sprinkler devices 54 (see FIGS. 2, 4 and 4A); each device 54 comprises a trough 54A having a multiplicity of holes 55 formed in and along the lower portion of same through which condensate supplied to sprinkler 54 is to flow by gravity to condensed heating vapor above level 43 in order to reduce the vapor pressure in vessel 6. The troughs 54A extend across the receiver and have their ends 56 suitably affixed to the receiver so that all condensate supplied to same drains out through holes 55. Condensate is supplied to the troughs 54A by their receiving condensate sprayed upwardly through distributor 44 when condensate is forced to distributor 44. Alternately, troughs 54A may be replaced by tubes or containers connected to an opening in the receiver shell. The tubes or containers have vent openings at the top and multiple holes at the bottom for sprinkling. The sprinklers can be made of aluminum or stainless steel to meet the requirement of each application.

The distributor tubes 40 and 44 are made of stainless steel or extra hard tungsten alloy or equivalents so that they will adequately handle any pressurized fluid passing through the openings of same. They may be suitably fixed within the vessel 6 in their indicated positions. All parts inside the receiver should be so fastened to the wall of same in such a way that maximum expansion can be absorbed without causing any damage. The horizontal tube type distributor 44 can be supported by a larger drainable tube welded to the said wall. The end of the distributor is inside said drainable tube for free expansion. It is important that the outlet openings 41 in the distributor 40 be located below the primary liquid level 43 of the condensate in the receiver 6. Receiver 6 may contain two or more such distributors 40, as desired. The distributors 40 and 44 are arranged so that the only outlet for the vapor supplied to the receiver is through the openings 41 and 45.

Receiver 6 is basically defined by encompassing wall structure 203 suitably sealed and reinforced to withstand the operating pressure of any particular case.

The receiver 5 (FIG. 3) has a pair of horizontally disposed vertically spaced, tubular distributors 46 and 48 that contain openings 47 and 49 respectively distributed along the entire length of the respective distributor tubes 46 and 48 within receiver 5. The distributor tube 46, which is of the same general type as distributor 44 (FIG. 2), is connected with line 25 through fitting 25A. Distributor 48 located adjacent the bottom of the vessel forming receiver 5 is a tube similar to distributor 44 and is connected with the line 28 through the fitting 28A. Line 26 is connected with the fitting 26A at the top of receiver 5, and the line 27 is connected with the fitting 27A at the bottom of receiver 5. Receiver 5 is also equipped with one or more of the sprinkler devices 54 that are operably associated with distributor 46 in the same manner as with distributor 44 of receiver 6.

Receiver 5, like receiver 6, is basically defined by encompassing wall structure 205 suitably sealed and reinforced to withstand the operating conditions contemplated by any particular application. Thermal insulation is required outside the wall 205.

Figure 3:
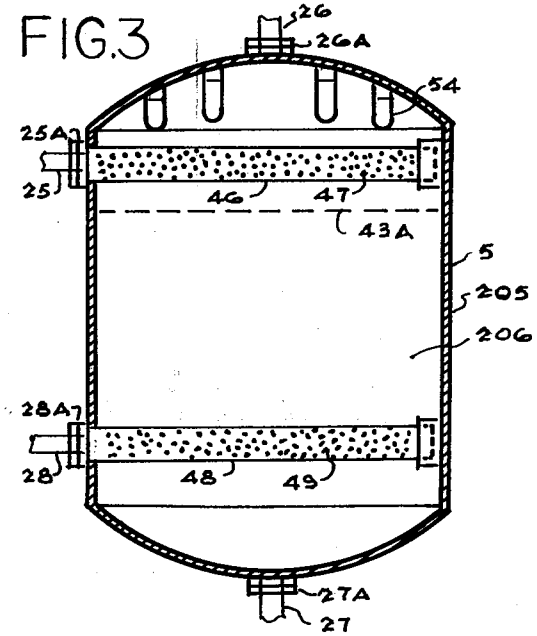
FIG. 3 is a view similar to that of FIG. 2 illustrating the other basic energy saving condensate receiver used in accordance with the invention.

It will be apparent that the vapor and condensate distributors shown in FIGS. 2 and 3 may be of other suitable distributing shapes that will effect adequate dispensing of the fluids involved within the respective vessels for purposes of condensing the vapor in same.

In operating the system shown in FIG. 1, the condensate accummulating in the equipment involved (for instance, a condensate tank), represented by vessel 200, and which is to be supplied to the vapor generator 202 by the practice of the invention, is pumped by the pump 1 from vessel 200 through the line 25 into the distributor 46 of receiver 5. The condensate passes through the distributor openings 47 into the chamber 206 defined by wall structure 205 to fill the vessel 5 up to the primary liquid level 43A. An automatic air vent arrangement of a suitable type is provided for receivers 5 and 6; same air vents are arranged to automatically release the air contained within the receivers 5 and 6 when the receiver involved is being charged with condensate in the first operating cycle. This may be done in any suitable manner. After the first cycle the receiver 5 is filled with vapor and then the receiver 5 is charged with condensate. The relatively cooler condensate shall cool the vapor through the distribution of distributor 46, and thus both the vapor pressure in the receiver and the pumping energy consumption are reduced.

When the liquid level 43A is reached in receiver 5, pumping is discontinued, and this may be achieved by employing a timer or suitable sensing device 1*a* which operates to discontinue the pumping action of the pump 1 when the level 43A is reached.

The heating fluid which may be steam at 270 degrees F., is introduced into the condensate now within the vessel 5 through line 28 and the perforated tube 48, and valve 13 is closed. The temperature of the condensate within receiver 5 will thereby be raised for example from approximately 180 degrees F. to approximately 215 degrees F. During the filling of the receiver 5 and the heating of the condensate, the valves 12 and 20 are closed so that no liquid or vapor escapes from the receiver 5. The valve 12 is opened briefly (about two seconds) to release to the atmosphere air trapped in receiver 5, when the condensate reaches approximately 215 degrees F.

After the condensate of receiver 5 has been heated to approximately the temperature level indicated and trapped air has been released, valve 14 is opened to balance the pressures of receivers 5 and 6 (except for the first operating cycle of the system there is high pressure steam remaining in receiver 6 from the previous cycle); the valve 15 is opened, and the condensate flows by gravity from the receiver 5 through line 27 into receiver 6, and specifically, through its distributor 44. The condensate is discharged through the distributor openings 45 into the chamber 207 defined by wall structure 203 of receiver 6. During the flow of condensate through the line 27, the valve 14 of line 31 is opened so that the pressure of receivers 5 and 6 remains equalized. After the condensate in receiver 6 reaches the level indicated at 43, the receiver 6 is isolated from receiver 5 by closing the valves 14 and 15. Heating fluid, for example, in the form of steam at approximately 320 degrees F. is then introduced into the condensate in receiver 6 through lines 34 and 29, by opening valve 16, and its discharges into said receiver 6 through its tube 40 and its openings 41. By this procedure the temperature of the condensate in vessel 6 is raised, for example, from approximately 240 degrees F. to approximately 280 degrees F. During this period the valves 17, 18 and 19 remain closed.

Valve 20 shall be opening to release vapor from receiver 5 for outside processing after said receiver is drained. This reduces the pressure inside receiver 5, and thus reduces the power requirements of pump 1.

To equalize the vapor pressure between the vapor generator 202 and the receiver 6, vapor from the vapor generator 202 is bled into the line 33 by opening valve 17. This high pressure vapor passes into tube 40 and is discharged through the openings 41 in the tube 40 and imposes on the condensate in vessel 6 a pressure approximately equal to that existing within the vapor generator.

It is now possible to pump the heated condensate from the vessel 6 to the vapor generator 202. At this point, the valve 18 is opened and the pump 3 is actuated to pump the condensate into the vapor generator 202, directly or indirectly.

After the receiver 6 has been drained, valves 17 and 18 are closed and the valve 19 may be opened to release vapor from the receiver 6 for external work of any useful character.

System A as shown in FIG. 1 may be operated in continuously repeating cycles of the type indicated to convey condensate from the receiver 200 to vapor generator 202. Lines 35 and 32 and the related valves can be omitted in some cases.

Figure 4:
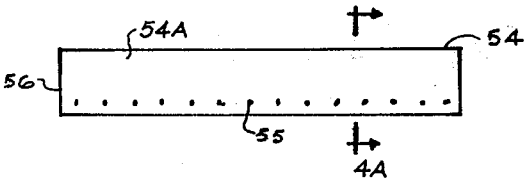
FIG. 4 is a fragmental elevational view of a liquid fluid sprinkling arrangement employed in the receivers of FIGS. 2 and 3.
Figure 5:
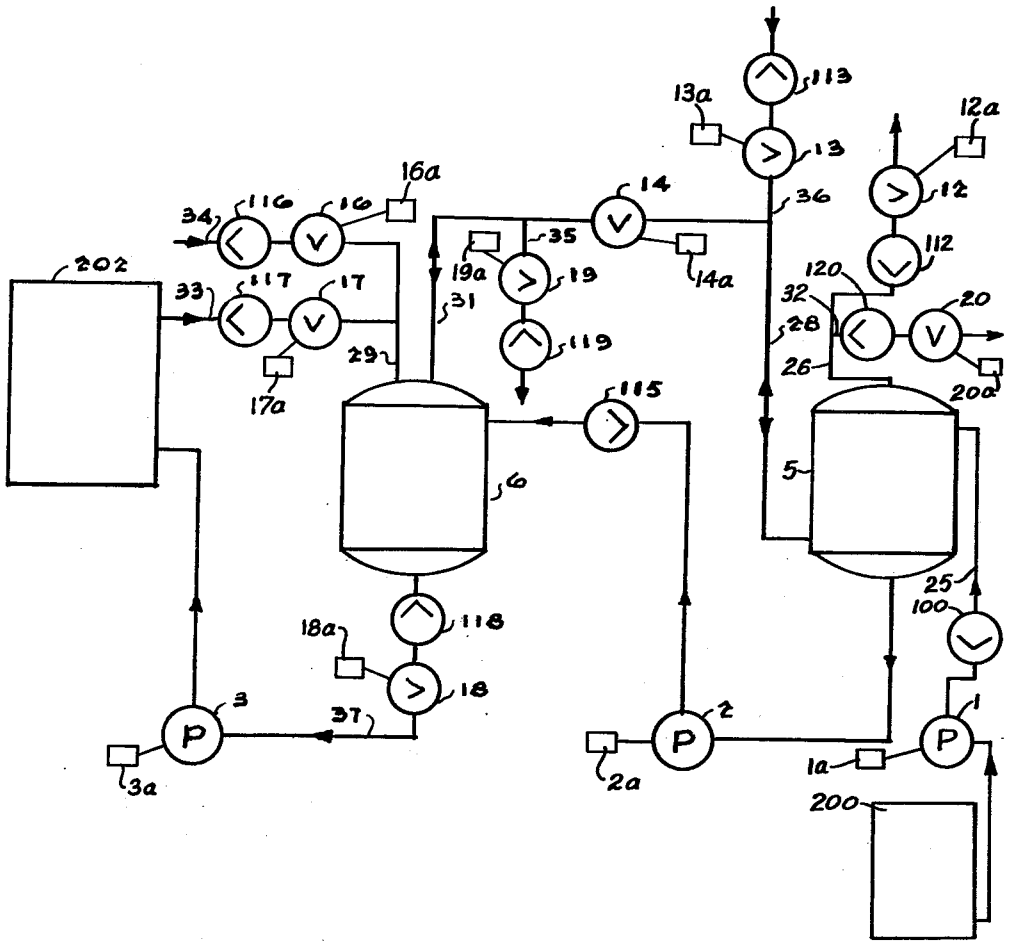
FIG. 5 is a view similar to that of FIG. 1 showing a modified arrangement of the embodiment of FIG. 1.
Figure 5A:
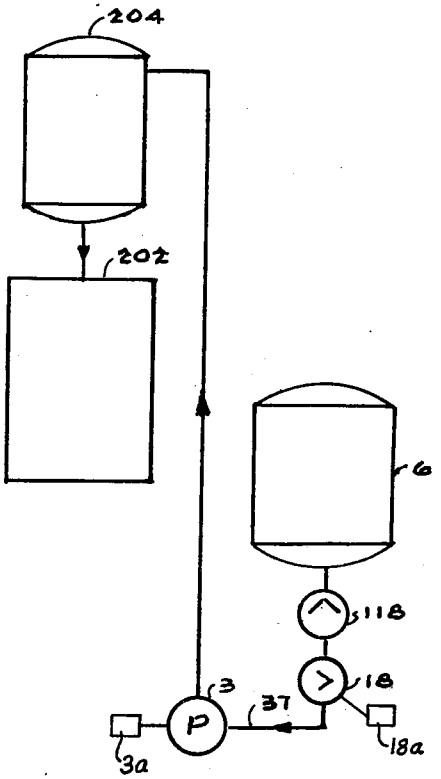
FIG. 5A is a fragmental view showing a variation in the embodiment of FIG. 5.

Referring now to FIG. 5, a system B is illustrated that is similar to system A except that a pump 2 is utilized in the line 27 to replace the shut off valve 15. This facilitates moving the condensate from the receiver 5 to receiver 6 at a faster rate than that afforded by gravity. The reference numerals of FIG. 5 that are identical to those of FIGS. 1–4 indicate like parts. FIG. 5A shows that pump 3 pumps the condensate to pressure vessel 204 and said condensate is charged from vessel 204 to the generator.

Figure 6:
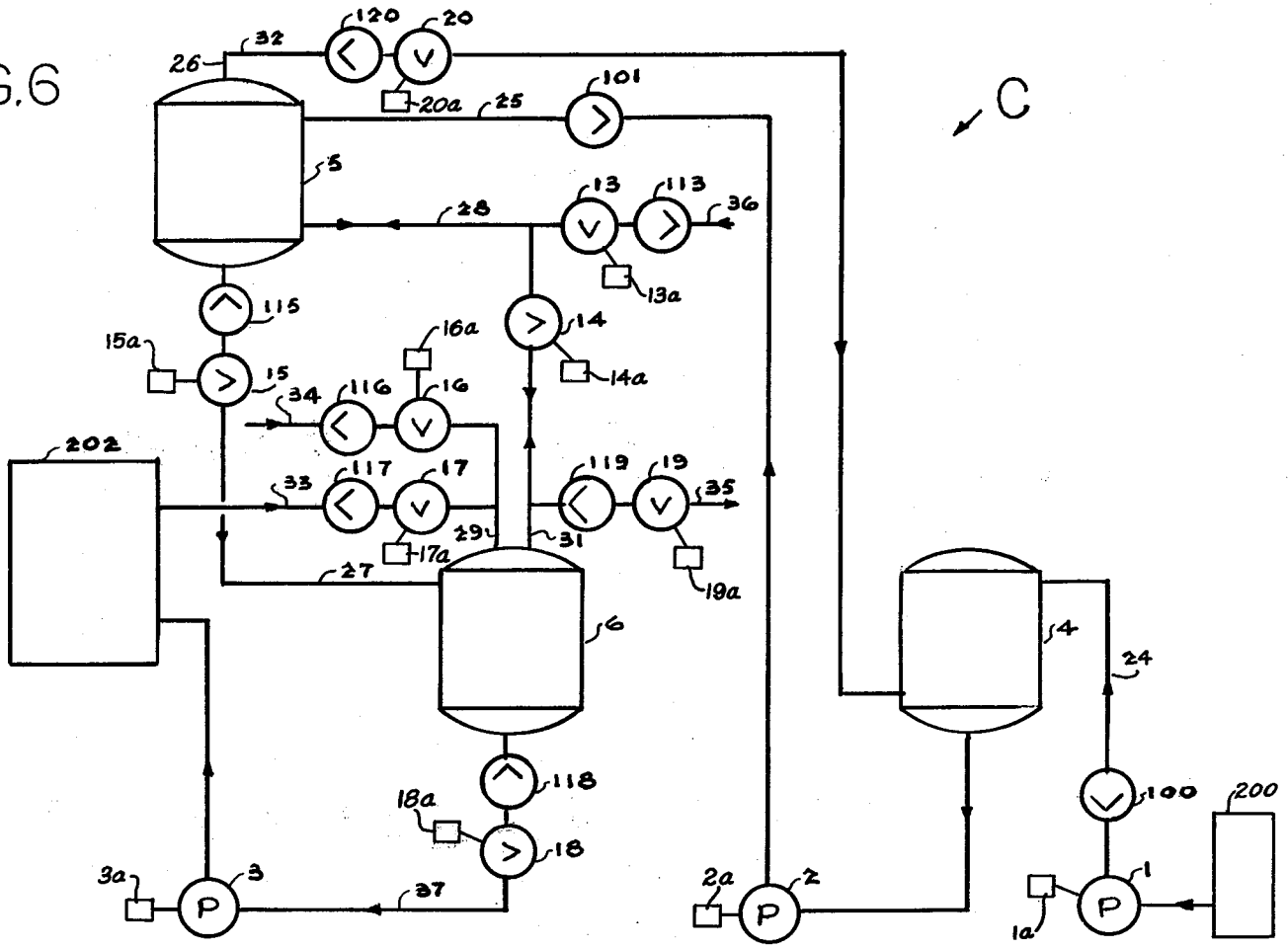
FIG. 6 is a view similar to that of FIGS. 1 and 5, illustrating a further form of the invention employing three of the indicated condensate receivers.

Referring to FIG. 6, the system C, is similar to that of FIG. 5 except that an additional receiver 4, that is arranged in the same manner as receiver 5, has been added. Line 32 in this embodiment connects line 26 at the top of receiver 5 to the lower portion of receiver 4 at its fitting which corresponds to fitting 28A of receiver 5. The pump 1 pumps condensate through the line 24 into the receiver 4 up to the primary liquid level of same. A distributor 48 such as the one shown in FIG. 3 is used to distribute the vapor to heat the condensate in receiver 4. The vapor in receiver 5 is the left over vapor from the previous cycle when said receiver is drained and isolated. The temperature of the condensate may be raised, for example, from about 100 degrees F. to about 130 degrees F. in vessel 4. The pump 2 in line 25 pumps condensate from vessel 4 to vessel 5 through check valve 100 and fitting 25A. Apart from these differences, the operation of the apparatus shown in FIG. 6 is the same as that described for the apparatus shown in FIG. 1.

The operating systems shown in the drawings can be used in fossil and nuclear fueled power or industrial plants. The selection of the specific arrangement employed should be based on the particular applications in each case. The word "condensate" refers to steam condensate or the condensate of any other vapor as the motive fluid, whenever it is applicable.

In the case of utilizing the method involved in the apparatus shown in FIG. 5, in a steam turbine fossil fuel power plant with a steam generator of 2,400 psig. pressure, steam is extracted from the turbines in six stages in which the steam temperature of the extract is approximately 150 degrees F., 190 degrees F., 240 degrees F., 380 degrees F., 460 degrees F., and 540 degrees F. During the operation, the vapor retained in the condensate receiver 6 should be approximately at 2,400 psig. pressure immediately after the receiver 6 is drained. Pump 1 can be used to pump condensate from a condenser, a deaerating tank, or a heat exchanger. For purposes of description, it is assumed that pump 1 is connected with condenser 200, and the pump 1 is to pump condensate at approximately 90 degrees F. from the condenser 200 into the receiver 5, up to the indicated predetermined water level 43A. A pre-set timer or float switch **1*a* is employed in the controls for pump 1 to shut off pump 1 when level 43A has been reached. Valve 13 represents three automatic valves in parallel and each valve with a check valve 113 is in separate piping. All three pipes are as shown as line 36; each pipe is connected to a source of steam extract. The first valve 13 is operated to release steam at 150 degrees F. into receiver 5 to heat the condensate in same up to approximately 130 degrees F., and the second valve 13 releases 190 degrees F. steam into receiver 5 to heat the condensate up to approximately 170 degrees F.; the third valve 13 releases steam at approximately 240 degrees F. to heat the condensate of receiver 5 up to approximately 210 degrees F.; then all the three valves 13 are closed. Valve 12 is open for approximately two seconds to release trapped air in the vessel 5** to the atmosphere.

Valve 14 is operated to release steam at not more than 2,400 psig. (received from generator 202 in previous cycle) from the receiver 6 into receiver 5 through a line 28, 31 and distributor 48, and this heats the condensate of vessel 5 up to approximately 300 degrees F. At this point, the vapor pressure in both receivers is balanced. While valve 14 remains open, in the form of FIG. 5, pump 2 pumps the condensate from receiver 5 into receiver 6. Valve 14 and pump 2 is shut off when the receiver 5 is drained.

Valve 16 represents three automatic valves 16 in parallel in the manner similar with valve 13. The lines 34 are connected to sources of steam extract. When the condensate has completely been transferred to receiver 6, and said receiver is isolated, the first valve 16 of this series is open to release steam of 380 degrees F. into vessel 6 to heat the condensate of receiver 6 up to approximately 340 degrees F., and the second valve releases steam of 460 degrees F. to heat the condensate up to approximately 420 degrees F. The third valve releases steam of 540 degrees F. to heat the condensate up to approximately 500 degrees F.; all three valves are then shut off. Such steam is released to the condensate through distributor 40 (FIG. 2).

Valve 17 is opened to release the superheat or saturate steam from the steam generator 200 at 2,400 psig. into the receiver 6 through distributor 40 and to raise the pressure in the receiver 6 up to approximately 2,400 psig. Valve 18 is then opened, and the pump 3 pumps the heated and pressurized condensate in receiver 6 into the steam generator 202, while valve 17 remains open. Valves 17, 18, and the pump 3 are shut off by a suitable pre-set timer arrangement immediately after the receiver 6 is drained. Valve 19 may be opened at this point for releasing a portion of the steam now present in the vessel 6 for use in supplying steam for other processing needs, and the valve 19 shall then be closed. Valve 20 may also be opened for approximately 2–4 seconds to release the steam in receiver 5 for outside process use immediately after the receiver 5 is drained. This operation reduces both the pressure in the receiver 5 and the horsepower requirements of pump 1 for the next cycle of the system. Valves 19 or 20 can be omitted when operation of the valve is not feasible in some cases.

In the indicated steam turbine power plant, the pump 1 in FIG. 5 can be connected to a deaerating tank instead of a condenser and a few condensate heaters can be installed in line 25 in series between the condenser and the deaerating tank.

Pump 1 in this system (system B) of FIG. 5 pumps the condensate from, for instance, a deaerating tank into receiver 5. In a situation where steam turbine extracts of 280 degrees F., 330 degrees F., 460 degrees F., and 540 degrees F. are used for condensate heating, the valve 13 shall be two automatic valves 13 in parallel on two separate lines as shown as line 36 in FIG. 5. The first such valve releases into receiver 5 the 280 degree F. steam to heat the condensate in receiver 5 up to approximately 250 degrees and the second valve releases steam at 330 degrees F. to heat the condensate up to 300 degrees F.; both valves are then closed. Valve 14 is opened to release the steam in the receiver 6 to heat the condensate in receiver 5 up to approximately 380 degrees F., and the pump 2 pumps the condensate from the receiver 5 into the receiver 6; while valve 14 is open, when receiver 5 is drained both valve 14 and pump 2 are then shut off. Valve 16 shall be two automatic valves 16 in parallel in a manner similar to valve 13. The first valve 16 is to release the 460 degrees F. steam into receiver 6 to heat the condensate therein up approximately to 420 degrees F., and the second valve 16 is to release steam at the 540 degree F. level to heat the condensate up to 500 degrees F. The rest of the operation shall be the same as it has been stated for the first example except that the released steam from valve 20 can be used to heat the condensate in the deair tank.

Pump 1 can also be used to pump condensate from a series of heaters and receiver 5 is used to remove trapped air by opening the valve 12 for approximately 2 to 4 seconds. The rest of the operation is in accordance with the same principle as stated before.

The liquid capacity of the vertical piping between receiver 5 and pump 2 and that between valve 118 and pump 3 shall be large enough to prevent the vapor in the pipe from getting into the suction side of the pumps. The size of said vertical pipes can be enlarged. A liquid container can be installed at said vertical pipes instead of enlarging the pipe size.

Timers can be used to control the operation of any automatic valve or any pump. Two timers can be used in parallel for any critical operation point. Whenever it is applicable, a float switch in any receiver or a flow switch downstream of any receiver can be used in parallel with related timers to stop the related pump operation. The control means for the various valves and pumps are schematically represented by similar respective reference characters with a subscript a, i.e. 1*a*, 3*a*, 12*a*, 18*a*, etc.

The piping arrangement employed shall provide space for any piping or equipment thermal expansion.

In order to obtain a continuous operation with little interruption, suitable automatic control devices can be used. Any malfunction of an automatic valve or that of a pump shall send a signal to the control room through suitable means to be provided. Additional automatic valves can be used in parallel with any of the automatic valves indicated, and a gate valve can be used at both sides of any automatic valve. In case of a malfunction of one automatic valve, the other valve in parallel is in operation and the malfunctioning valve can be isolated by the gate valves. The necessary repair can then take place without interrupting the condensate processing.

The heating steam employed in accordance with the invention may contain a portion of the condensate at the same temperature. In some cases where the condensate is available at adequate temperature and pressure, it can be released into one receiver through its distributor and controlled by a valve and timer. This saves the energy of pumping.

All the automatic valves in the system shall be opened at an adequate speed to prevent a harmful impact of the vapor or liquid. The piping arrangement shall minimize such impacts by using piping of adequate size and adequate length. The size of a distributor 40, 44, 46 and 48 shall be large enough and the end of a distributor shall be strong enough to take any possible impact.

In some cases, when the heating vapor is released into the condensate in a vessel 5 or 6, a portion of the vapor reaches the top of the receiver and gradually builds up a vapor pressure. This pressure may slow down the process of releasing heating fluid. Open top sprinklers 54 as shown in FIGS. 2–4 can be used to reduce this vapor pressure. The said sprinklers are filled with comparatively cooler condensate through the condensate distribution of distributors 44, 46. Said sprinklers operate by gravity to sprinkle the condensate slowly through the small openings 55 at the bottom of the sprinklers (see FIG. 4). The sprinklers are in operation until the end of the heating vapor releasing into the related receiver 5 or 6. The comparatively cooler sprinkled condensate cools the indicated vapor that reaches the top of the receiver (5 or 6), and causes a portion of such vapor to be condensed; thus the pressure of such vapor is reduced. Whenever it is feasible, a motor forced sprinkler system can be used to replace the open top gravity sprinkler illustrated. In such case, a motor operated pump is used to pump comparatively cooler condensate from any adequate source into such sprinklers.

Except for air releasing piping, all equipment and piping that contains the condensate in the system shall be insulated to preserve energy.

In an exemplary case of an industrial plant condensate feeding system arranged in accordance with system B (FIG. 5), a 1,000 psig. steam boiler supplies all process steam to the plant. Almost all steam condensate is returned to the boiler room, and 40 percent of such condensate is at approximately 190 degrees F. when it reaches a condensate deaerating tank in the boiler room; such tank is connected with the suction side of pump 1 and equipped with a suitable air releasing valve and piping.

Two types of equipment in said plant discharge steam mixed with condensate and the discharge fluid temperature shall be 350 degrees F. and 450 degrees F.

When the system shown in FIG. 5 starts to operate, the pump 1 pumps the condensate from the deaerating tank into the receiver 5 to the primary liquid level. Valve 13 is open to release the said fluid of 350 degrees F. temperature into such receiver 5 through distributor 48, and to heat the condensate up to approximately 320 degrees F.; valve 13 is then closed. Valve 14 is opened to release not more than 1,000 psig. steam in the receiver 6 (the steam remained in the receiver from previous cycle) into the receiver 5 through the distributor 48, and the vapor pressure in the two receivers shall then be balanced. Pump 2 shall then pump the condensate in receiver 5 into the receiver 6, and both valve 14 and pump 2 shall then be shut off. Valve 16 is opened to release the fluid of 450 degrees F. through the distributor 40 of vessel 6 to heat the condensate in receiver 6 up to approximately 410 degrees F., and the valve 14, 16 shall then be shut off. The valves 19, 119, 12 and 112 remain closed, and the valve 20 is employed to release steam into the deaerating tank and to heat the condensate therein. The air releasing valve of such tank shall release air from the tank with adequate timing, by utilizing a timer to meet each particular requirement. The rest of the operation shall be the same as stated previously.

In this method, the energy of the 1,000 psig. steam released from the boiler into the receiver 6 almost completely goes back to the boiler. The consumption of electricity of the condensate feeding in this method is less than 10 percent of that in a traditional feeding system. The receivers, the tank and the boiler are at approximately the same level whereby the pressure head required by pumps 1, 2 and 3 is very low. It shall not exceed 80 psig. It requires less than 100 feet of piping in this system, and thus the effectual energy loss due to piping friction is very limited. Where any of the indicated pumps are in operation, the pressure difference between the suction side and the discharge side shall not exceed 15 psig. because the pressure of both sides is balanced before pumping.

The vapor pressure in the indicated tank 200 is approximately 0 psig. and that of the boiler is 1,000 psig. The pressure head required by the pump in a traditional method is 1000 psig. plus the friction loss in the piping. The total pressure head thus required for the pumping is more than 1,000 psig. In a traditional arrangement, it takes additional energy to treat the condensate in said fluid of 350 degrees F. and 450 degrees F.

For example, an existing plant requires a series of new equipment with 1,000 horsepower electrical requirements. It takes two miles of wiring and additional electrical equipment to meet the new equipment, and this is very costly. A traditional boiler condensate feeding system in the plant requires a 1,200 horsepower pump motor.

A 1,050 horsepower saving is effected if the condensate feeding system shown in FIG. 5, is used with consequent saving of installation and operation costs. Further, the energy saving by the present invention is more than 90 percent.

The capacity of the receiver 6 is desirably considerably larger than that of receiver 5. Additional heating fluid is added into receiver 6 and the final condensate temperature in receiver 6 is hotter than that in receiver 5, and thus the volume of the condensate in receiver 6 is larger. It is understood that the ratio of said capacities between the two receivers shall be determined by each particular application.

It is also understood that either of valves 13 or 16 and associated piping can be omitted where not needed.

Referring again to FIG. 1, there is shown a system that operates in the same way that has been described, as shown in FIG. 5, except that the condensate in receiver 5 is drained by gravity into receiver 6 by opening the valve 15 instead of operating pump 2 of the FIG. 5 arrangement. The system shown in FIG. 1 is suitable for smaller operations which allows the time requirements of gravity drainage.

In a system there may be more than two receivers in series instead of the two receivers shown in FIGS. 1 and 5.

Generally speaking, to transport the condensate by pumping is faster than by gravity drain. The receiver should be larger when the process timing is prolonged.

In a project in which the vapor generator is under 400 psig. vapor pressure, and the released vapor from the receiver can be very adequately utilized, the pump 2, receiver 5, and its accessories can be omitted. In this system, pump 1 shall pump the condensate directly into receiver 6, and the rest of the process shall be the same as stated before.

This invention is susceptible of many embodiments utilizing the principles herein described. To avoid prolixity detailed description of many of the numerous possible embodiments has been omitted. However, FIGS. 6 and 7 are provided to show two additional embodiments.

FIG. 6 illustrates a system in which another receiver 4 and a pump are added to the system shown in FIG. 1. The receiver 4 is located upstream of the receiver 5 and the process between receiver 4 and receiver 5 is the same as it is between receivers 5 and 6 shown in FIG. 5.

Said receivers 4 and 5 are constructed in the way as shown in FIG. 3, but each receiver is built to meet its particular operating condition.

Figure 7:
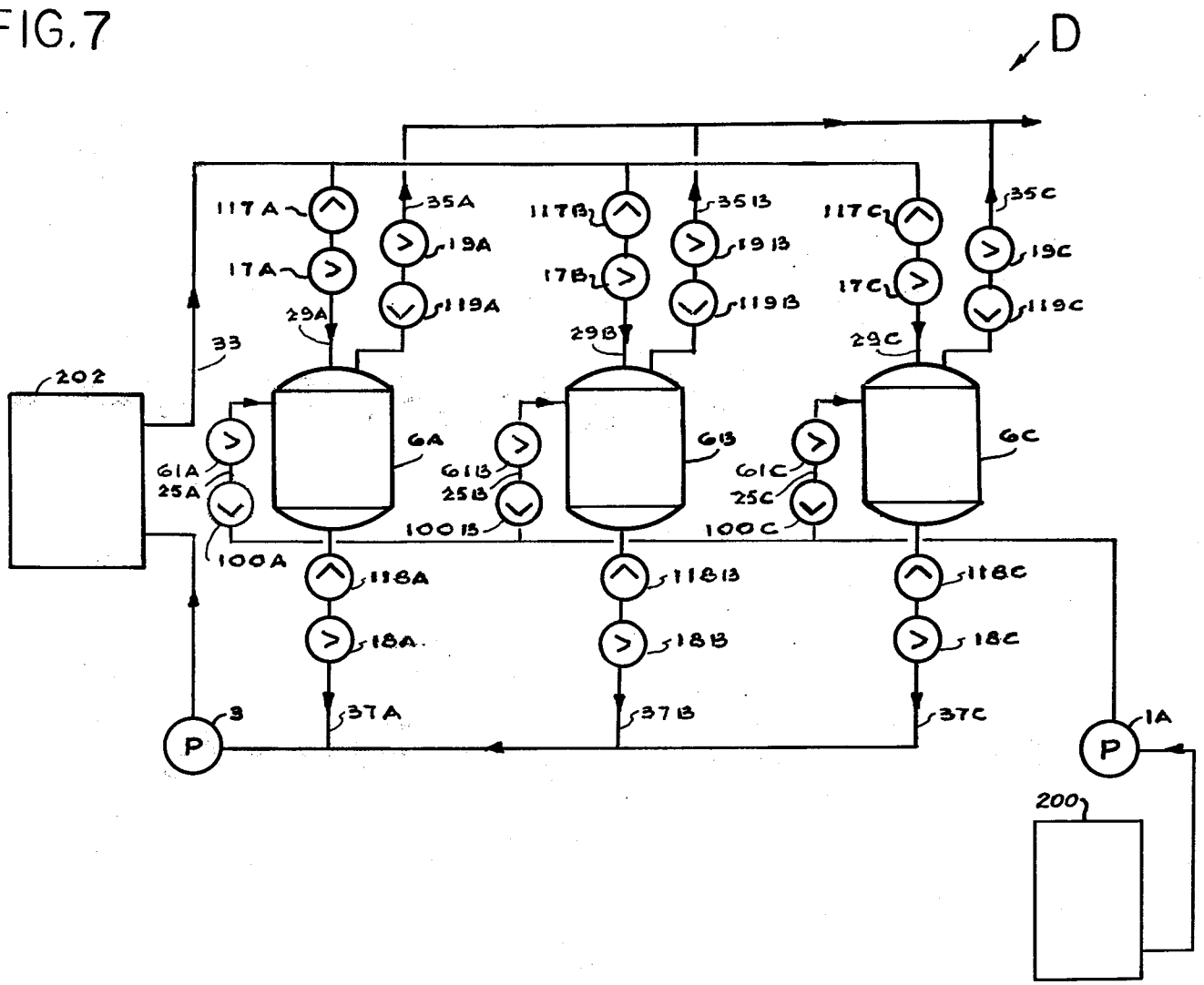
FIG. 7 is a view similar to that of FIG. 1 illustrating yet a further embodiment of the invention employing multiple pressure vessels.

FIG. 7 shows an arrangement that keeps pumps 1A and 3 in continuous operation. This involves the vapor generator 202 receiving the condensate continuously. In accordance with this arrangement, at least three receivers 6A, **6*b*, and 6C are required, and such receivers are then operated in a rotational way to keep the pumps in operation continuously. Each of the receivers 6 operates in the same way as previously stated, and the indicated rotational sequence involves means that before the valve of one receiver 6 is closed, the identical valve of the other receiver 6, which is next in rotational order, shall be fully opened. Timers should be employed to control this operational feature involved. It is adviseable to have a standby receiver 6 with all the fittings required available. The control system can be arranged so that the standby receiver 6 is available for use to replace any of the receivers 6** being utilized.

A system which is similar to the one shown in FIG. 7 is to replace each of the receivers 6 with a two receiver system as shown in FIGS. 1 and 5.

The term "pump 3 pumps condensate into the vapor generator" includes all the ways that can be used to pump condensate into said generator 202 directly or indirectly. The indirect way means that the pump pumps the condensate into a pressure vessel and from that vessel the condensate is drained or pumped into the generator as shown in FIG. 5A. If the said vessel is used and the vessel has enough capacity of storage, the generator can receive a continuous condensate supply without using the suggested rotational methods described. Quite a number of minor changes may be employed as desirable or necessary, to meet a particular need but the basic principles of the methods herein disclosed are the same. The term high pressure vapor used in this disclosure includes all types of vapor which have at least 50 psig. operating pressure. It can be a heat exchanger, a boiler or a nuclear reactor.

The piping and the valves used in accordance with the invention shall be such as to withstand the pressures and temperatures of the operational conditions encountered. Stainless steel can be used in a delicate rust free operation. Steel pipe manufacturers provide all particular details for any particular requirement.

The term "generator", "a pump", "a tank", and "a receiver" as used herein indicates at least one of such equipment, but these terms are not limited to mean just one equipment component thereof.

When a distributor is used to distribute relatively cool condensate into a receiver, said condensate can cool the relatively hotter vapor therein, and thus the vapor is cooled and the vapor pressure is immediately reduced. This operation is used to reduce the condensate pumping energy by reducing the pump pressure head requirements.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A high efficiency energy saving condensate feeding system for feeding condensate into a high pressure vapor generator of more than 100 psig vapor pressure, comprising:

a first and a second energy saving high pressure vessels filled with the same kind of vapor as is generated by said generator and said vapor in said first vessel being high pressure vapor of which at least most of the energy content is to be restored to the system;

a condensate charging line for charging condensate into said second vessel;

a vapor releasing line leading from said first vessel into said second vessel;

a vapor bleeding line leading from a high pressure vapor source to said first vessel;

a condensate discharge line leading from said second vessel to said first vessel;

a condensate feeding line leading from said first vessel to said generator;

a pump for feeding condensate from said first vessel to said generator through said condensate feeding line;

means for charging said condensate through said condensate charging line into said second vessel to fill up to a predetermined primary liquid level in said second vessel;

valve means for isolating said second vessel from said condensate charging line;

a high pressure vapor distributor with multiple openings under the liquid level in said second vessel;

first valve means in said vapor releasing line for releasing high pressure vapor from said first vessel into said second vessel and for injecting said high pressure vapor into the condensate in said second vessel through said high pressure vapor distributor for reducing the vapor pressure by condensing a portion of the vapor and for preserving the energy content of the condensed vapor;

second valve means for controlling the discharge of said condensate from said second vessel into said first vessel through said condensate discharge line;

said first and second valve means being operable for isolating said first vessel from said second vessel;

third valve means in said vapor bleeding line to bleed high pressure vapor from a high pressure vapor source to said first vessel to build up a pressure head in said first vessel for assisting condensate feeding into said generator;

said pump in said condensate feeding line being operable for pumping said condensate from said first vessel into said generator through said condensate feeding line until said first vessel is selectively drained while said third valve means in said vapor bleeding line is selectively opened to permit said bleeding of vapor into said first vessel;

and said third valve means in said vapor bleeding line being operable for selectively isolating said first vessel from said high pressure vapor source.

2. A system according to claim 1, comprising:

a condensate distributor with multiple openings disposed in said second vessel;

and means for charging relatively cooler condensate through said condensate charging line into said second vessel and to inject said condensate through said multiple openings of said condensate distributor into the vapor to condense a portion of said vapor for reducing the vapor pressure.

3. A system according to claim 1, comprising:

a condensate distributor with multiple openings disposed in said first vessel;

and means for charging condensate from said second vessel into said first vessel and to inject said condensate into said vapor in said first vessel through said multiple openings to said condensate distributor to condense a portion of said vapor for reducing the vapor pressure.

4. A system according to claim 3, comprising:

a condensate distributor with multiple openings disposed in said second vessel;

and means for charging relatively cooler condensate through said condensate charging line into said second vessel and to inject said condensate into said vapor in said second vessel through said multiple openings of said condensate distributor to condense a portion of said vapor for reducing the vapor pressure.

5. A system according to claim 1, including:

at least one valved releasing line leading from a source of used process vapor to at least one of said pressure vessels;

an additional vapor distributor with openings under the liquid level in said one vessel;

valve means in said used vapor releasing line for releasing said used process vapor into said one pressure vessel and to inject said vapor into the condensate therein through said vapor distributor for preserving most of the latent heat of said used process vapor by condensing most of said vapor in said condensate, after said one vessel is charged with condensate.

6. A system according to claim 5, including:

sprinkler means in the top portion of said one vessel for sprinkling relatively cooler condensate to cool the vapor above the condensate liquid level in said one vessel for reducing the vapor pressure in said one vessel while said used process vapor is injected into said condensate.

7. A system according to claim 5, including:

a condensate distributor in said one vessel; and at least one open top gravity operated sprinkler in the top portion of said one vessel for receiving relatively cooler condensate distributed by said condensate distributor;

said sprinkler being adapted for sprinkling relatively cooler condensate to reduce the vapor pressure above the liquid level in said one vessel, while said vessel is subjected to said used vapor condensing.

8. A system according to claim 7, wherein:

said condensate distributor has multiple openings for shower distribution of the condensate therefrom to cool the top portion of said vessel.

9. A system according to claim 1, including:

a third pressure vessel;

a condensate communication line leading from said third vessel to said second vessel;

a vapor pressure balancing line leading from second vessel to said third vessel;

means for charging condensate into said third vessel up to a predetermined primary liquid level a vapor distributor in said third vessel;

fourth valve means in said balancing line for releasing vapor from said second vessel into said third vessel through said vapor distributor for injecting said vapor into the condensate in said third vessel to condense most of said vapor;

a condensate distributor with multiple openings in said second vessel;

fifth valve means for feeding condensate from said third vessel into the second vessel through said communication line and said condensate distributor;

and fourth and fifth valve means being operable for isolating said second vessel from said third vessel.

10. A system according to claim 1, wherein:

said high pressure vapor bleeding means bleeds said vapor from said vapor generator.

11. A high efficiency energy saving condensate feeding system for feeding condensate into a high pressure vapor generator of more than 100 psig vapor pressure, comprising:

first and a second energy saving high pressure vessels filled with the same kind of vapor as is generated by said generator and said vapor in said first vessel being high pressure vapor of which at least most of the energy content is to be restored to the system;

a condensate charging line leading from said second vessel into said first vessel;

a pump in said condensate charging line;

means for charging condensate into said second vessel to fill said second vessel up to a substantial liquid level in said second vessel;

means for selectively isolating said second vessel;

a vapor distributor with multiple openings under the liquid level in said second vessel;

means for releasing high pressure vapor in said first vessel into said second vessel and to inject said vapor into the condensate in said second vessel through said vapor distributor for reducing the vapor pressure by condensing a portion of said vapor and to preserve the energy content of said condensed vapor;

said pump in said condensate charging line being operable for charging and condensate from said second vessel into said first vessel;

means for isolating said first vessel from said second vessel;

a high pressure vapor source;

means for bleeding high pressure vapor from said high pressure vapor source into said first vessel to build up a pressure head in said first vessel for assisting condensate feeding into said generator;

means for charging said condensate from said first vessel into said generator until said first vessel is selectively drained while said vapor bleeding means is selectively in operation; and means for selectively isolating said first vessel from said high pressure vapor source.

12. A high efficiency energy saving method for feeding condensate into a high pressure vapor generator of more than 100 psig vapor pressure, comprising:

providing first and second energy saving high pressure vessels and filling said vessels with the same kind of vapor as is generated by said generator, and the vapor in said first vessel being high pressure vapor of which at least most of the energy content is to be restored to the system;

charging condensate into said second vessel and filling the second vessel up to a substantial liquid level in said second vessel;

selectively isolating said second vessel;

releasing said high pressure vapor in said first vessel into said second vessel and injecting said high pressure vapor into the condensate in said second vessel through a vapor distributor with multiple openings under the liquid level in said second vessel and thereby reducing the vapor pressure and condensing a portion of said vapor and preserving the energy content of said condensed vapor;

charging said condensate from said second vessel into said first vessel;

isolating said first vessel selectively from said second vessel;

bleeding high pressure vapor from a high pressure vapor source into said first vessel and building up a pressure head in said first vessel and thereby assisting condensate feeding into said generator;

charging said condensate from said first vessel into said generator until said first vessel is selectively drained while said vapor bleeding is selectively in operation; and selectively isolating said first vessel from said high pressure vapor source.

13. A method according to claim 12, which comprises:

charging relatively cooler condensate into said second vessel through a condensate distributor with multiple openings disposed in said second vessel;

and injecting said condensate through said openings into said vapor in said second vessel and thereby reducing the vapor pressure and condensing a portion of said vapor.

14. A method according to claim 12, which comprises:

charging said condensate from said second vessel into said first vessel through a condensate distributor with multiple openings disposed in said first vessel;

and injecting said condensate through said openings into said vapor in said first vessel and thereby reducing the vapor pressure and condensing a portion of said vapor.

15. A method according to claim 13, which comprises:

charging relatively cooler condensate into said second vessel through a condensate distributor with multiple openings disposed in said second vessel;

and injecting said condensate through said openings into said vapor in said second vessel and thereby reducing the vapor pressure and condensing a portion of said vapor.

16. The method according to claim 12, comprising:

partially releasing vapor from said first vessel for process work outside of said first vessel immediately after said first vessel is drained and isolated.

17. A method according to claim 12, comprising:

partially releasing vapor from said second vessel for outside process work immediately after said first vessel is drained and isolated.

18. A method according to claim 12, comprising:

releasing used process vapor into the condensate of at least one of said vessels through a vapor distributor therein with multiple openings;

and thereby condensing most of said vapor in said condensate for preserving most of the latent heat of said used vapor.

19. A method according to claim 12, comprising:

releasing condensate of relatively high temperature into the condensate in one of said vessels through a fluid distributor therein;

and thereby heating the condensate in said one vessel.

20. A method according to claim 18, comprising:

sprinkling relative cooler condensate from at least one condensate sprinkler in the top of one of said vessels;

and thereby cooling vapor in said one vessel and reducing the vapor pressure in said one vessel.

21. A method according to claim 18, which comprises:

releasing said used vapor into said one vessel through at least one vapor distributor therein from different vapor sources of different temperatures and such releasing being in multiple stages.

22. A method according to claim 12, comprising:

charging said condensate from said first vessel into an additional pressure vessel;

and then charging condensate from said additional pressure vessel into said vapor generator.

23. A method according to claim 22, comprising:

charging condensate into said generator at a predetermined speed as a non-stop continuous operation.

24. A method according to claim 12, comprising:

releasing trapped air from said second vessel when the condensate temperature in said vessel is above 212° F.

25. A method according to claim 12, comprising:

effecting all the operations, except charging condensate into said second vessel and pumping, by opening an automatic valve for fluid releasing and closing one or two automatic valves for said isolating;

controlling each valve with a respective adjustable preset timer connected thereto;

and controlling each valve by means of a respective adjustable preset timer connected thereto.

26. A method according to claim 18, comprising:

operating at least three sets of said vessels in an order of rotation, and thereby maintaining continuous releasing of said used vapor into said vessels.

27. A method according to claim 12, comprising:

operating at least three sets of said vessels in an order of rotation;

and thereby maintaining continuous condensate feeding to said generator from said vessels.

28. A method according to claim 12, which comprises:

bleeding vapor from said high pressure vapor source into the condensate in said first vessel through a vapor distributor therein with multiple openings and thereby heating said condensate and imposing a pressure head in said first vessel.

29. A method according to claim 15, which comprises:

sprinkling condensate from at least one open top sprinkler in the top of said one vessel for reducing the vapor pressure above the liquid in said one vessel.

30. A method according to claim 12, including:

providing a third pressure vessel in series with said second vessel;

charging condensate into said third vessel to fill same up to a predetermined primary liquid level;

releasing and injecting vapor from said second vessel into said condensate in said third vessel through a vapor distributor with multiple openings to condense a portion of said vapor in said condensate for reducing the vapor pressure in said third vessel;

and charging said condensate from said third vessel into said second vessel.

31. A method according to claim 12, which comprises:

bleeding superheated vapor into said first vessel from said high pressure vapor source to build up said vapor head.

* * * * *